US005343642A

United States Patent [19]

Magnusson

[11] Patent Number: 5,343,642

[45] Date of Patent: Sep. 6, 1994

[54] PICTURE FRAME ASSEMBLY

[76] Inventor: Emanuela F. Magnusson, 350 E. 57th St., New York, N.Y. 10022

[21] Appl. No.: 74,970

[22] Filed: Jun. 10, 1993

[51] Int. Cl.[5] ..... G09F 1/12

[52] U.S. Cl. ..... 40/152.1; 40/152; 40/155; 403/292

[58] Field of Search ..... 40/152, 152.1, 155; 403/405.1, 292, 294, 293

[56] References Cited

U.S. PATENT DOCUMENTS

| | | | |
|---|---|---|---|
| 2,259,434 | 10/1941 | Blodgett | 40/154 |
| 5,079,860 | 1/1992 | Nugent | 40/152 |
| 5,090,835 | 2/1992 | Cox | 403/292 |
| 5,240,060 | 8/1993 | Blakely | 403/292 |

FOREIGN PATENT DOCUMENTS

| | | | |
|---|---|---|---|
| 494460 | 7/1950 | Belgium | 40/152.1 |
| 288923 | 9/1931 | Italy | 40/152.1 |

*Primary Examiner*—Kenneth J. Dorner
*Assistant Examiner*—Cassandra Davis
*Attorney, Agent, or Firm*—Hopgood, Calimafde, Kalil & Judlowe

[57] ABSTRACT

A picture frame is formed by assembling two C-shaped sections. The free ends of a U-shaped clip are inserted into a pair of adjacent openings, one of which is formed in each frame section. The clip serves to secure the two frame sections and provide support for the assembled frame. One of the frame sections may include a laterally extending pin which is received in an opening in the other frame section to achieve closer engagement of the frame sections in the assembled picture frame.

11 Claims, 2 Drawing Sheets

PICTURE FRAME ASSEMBLY

FIELD OF THE INVENTION

The present invention relates generally to picture frames, and more particularly to a picture frame that affords greater ease of assembly and more reliable display.

BACKGROUND OF THE INVENTION

Picture frames for displaying photographs or the like are found in practically every home and office. They typically include a rectangular or square border and a glass window to protect the contents. The typical frame also includes an opaque back plate with a fixed support to allow the frame to be mounted on a surface.

Although conventional picture frames are available in a wide variety of designs, most require the removal of the back plate and insertion of the photograph followed by replacement of the back plate. This assembly is often cumbersome. Moreover, the support provided to the frame is frequently unreliable and easily broken when the picture frame is dropped or mishandled. Some conventional picture frames, once assembled, are not sufficiently secure and may come apart when the frame is dropped.

It is accordingly an object of the present invention to provide a picture frame construction which is easy to assemble with a secure and tight closure.

It is a further object of the invention to provide a picture frame which has a secure support.

It is another object of the present invention to provide a picture frame of the type described which requires a minimum number of components and which is relatively inexpensive.

SUMMARY OF THE INVENTION

In accordance with the present invention, a picture frame includes two frame sections, one of which may include an extending projection or pin which is received in a slot or hole provided in the other frame section to provide a secure and tight fit between the two frame sections. In an additional aspect of the invention, an opening is provided in each frame section to receive one of the free ends of a support member, which provides retention of the two frame portions as well as a foot or support to maintain the assembled frame in a vertical or near vertical display position.

BRIEF DESCRIPTION OF THE DRAWINGS

For a better understanding of the invention and its end use application, reference will now be made by way of example to the accompanying drawings.

DETAILED DESCRIPTION OF THE INVENTION

Figure 1:
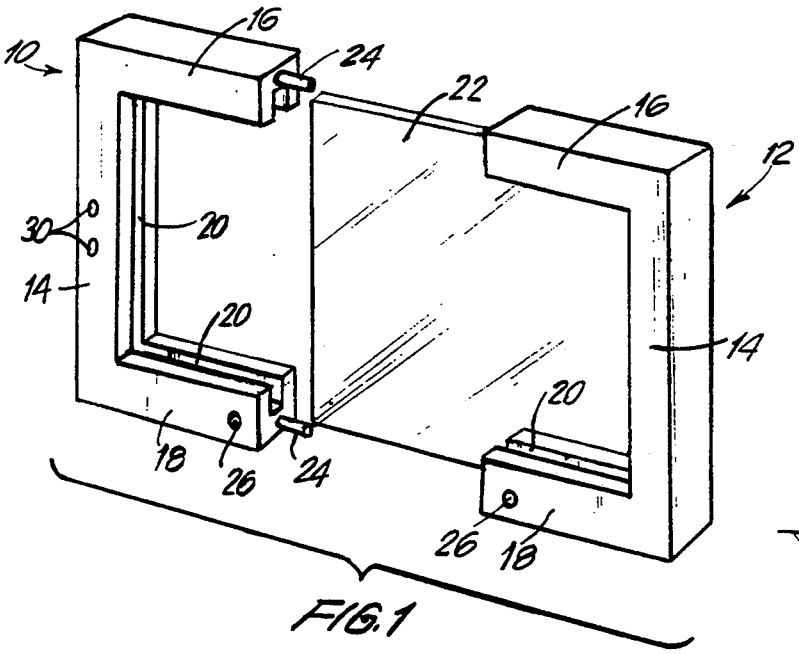
FIG. 1 is an elevation of a picture frame according to one embodiment of the present invention, shown in the process of being assembled.
Figure 2:
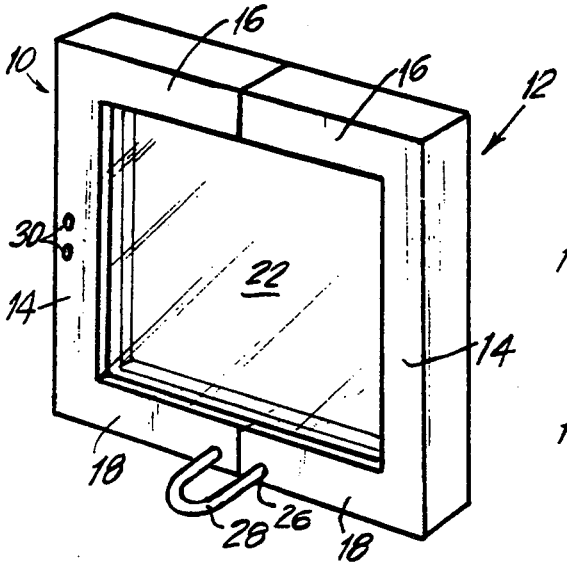
FIG. 2 is an elevation of an assembled picture frame according to the FIG. 1 embodiment.

In the embodiment of the invention illustrated in FIGS. 1–4, the picture frame of the invention comprises two C-shaped frame sections 10 and 12 which may be advantageously made of a metal, such as aluminum. Each frame section 10, 12 includes a vertical segment 14 and opposing upper and lower legs 16, 18. A central groove 20 is formed along the interior of each frame section 10, 12 and glass pane 22 is initially inserted into the groove of one frame section (12 as shown in FIG. 1). Thereafter, as shown in FIG. 2, glass pane 22 is inserted into the groove in the other frame section 10 and the two sections are placed in close proximity so that their upper ends engage one another, as shown in FIG. 2.

In one aspect of the invention, one of the frame sections (10 in FIG. 1) includes pin 24 that projects laterally from upper leg 16 of frame section 10 and is received in a registering hole (not shown) formed in upper leg 16 of frame portion 12, to provide a tight fit between the two frame sections.

Figure 3:
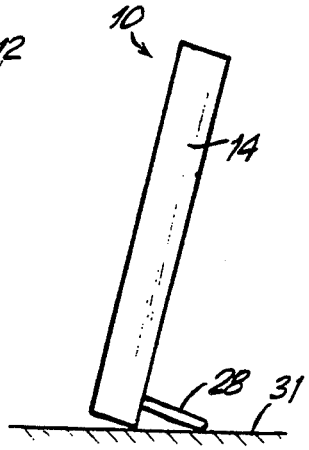
FIG. 3 is a side view of the picture frame of FIG. 2.

In accordance with another aspect of the invention, opening 26 is formed in lower leg 18 of each of frame sections 10, 12 near the outer end of each lower leg. The free end of a U-shaped clip or support 28 is inserted respectively into openings 26. The insertion of support 28 in this manner serves to secure frame sections 10, 12 in the assembled condition and further, as shown in FIG. 3, it serves as a support for the assembled frame, when the frame and support are placed on a horizontal surface 31.

Figure 4:
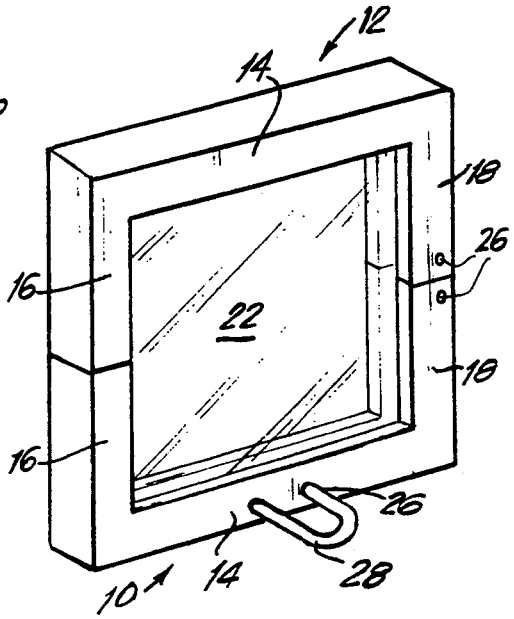
FIG. 4 is a view similar to FIG. 2 showing the U-shaped support placed for horizontal support of the frame.

A pair of additional openings 30 may be formed in vertical segment 14 of frame section 10. If the increased security of the picture frame assembly provided by support 28 is not deemed necessary or desired, both ends of support 28 may instead be inserted into openings 30 so that the frame may be mounted for display in a horizontal orientation as shown in FIG. 4.

Figure 5:
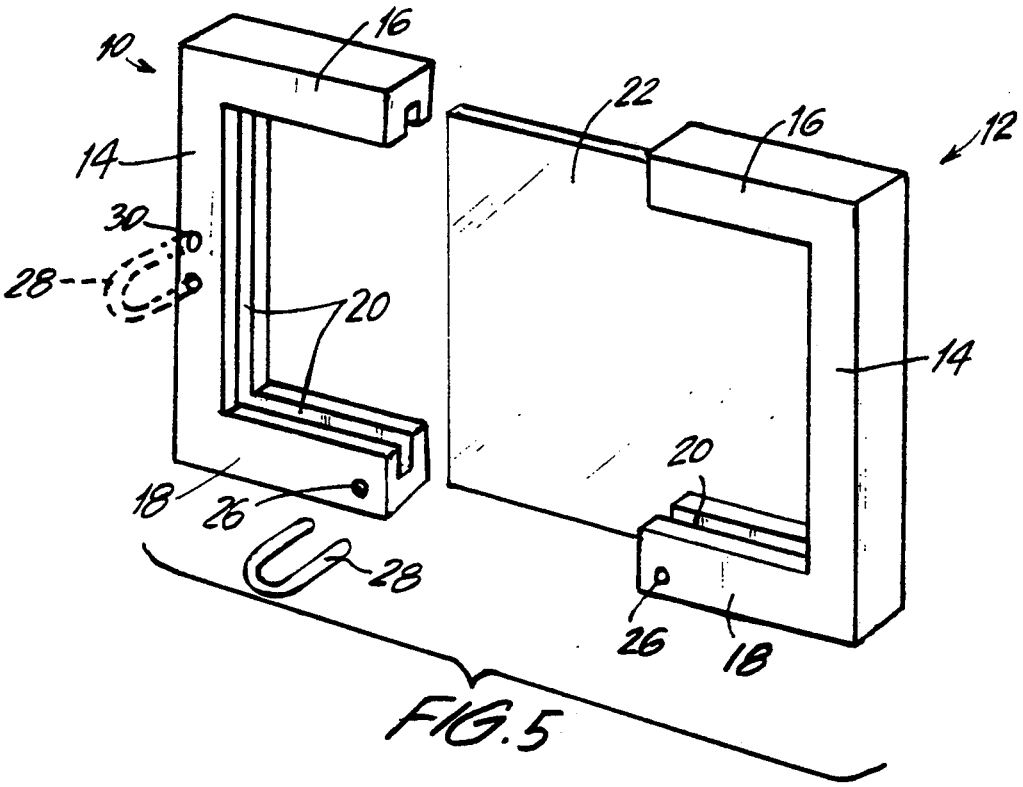
FIG. 5 is a view similar to FIG. 1. It displays a picture frame in accordance with a second embodiment of the present invention.
Figure 6:
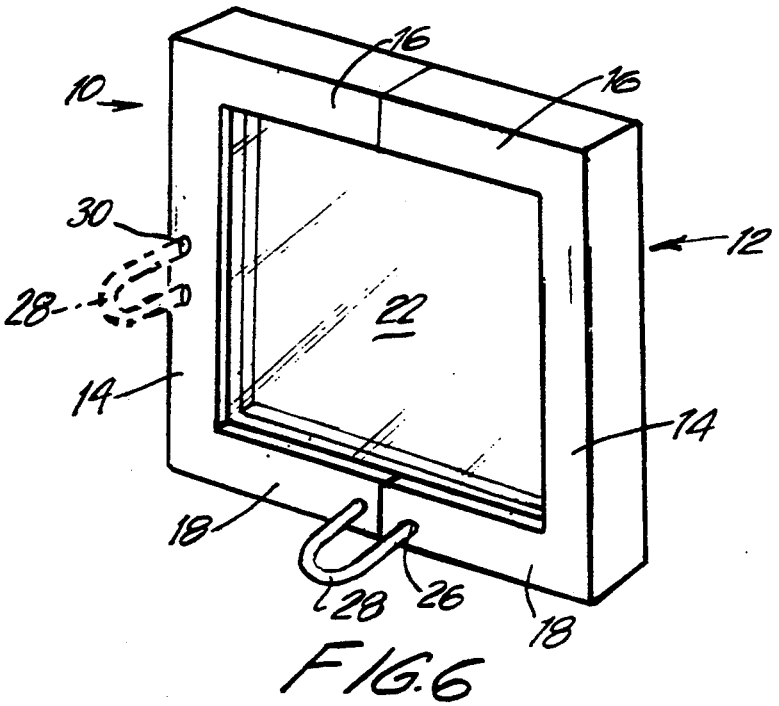
FIG. 6 is an assembled picture frame of the embodiment of FIG. 5.

The embodiment of the picture frame shown in FIGS. 5 and 6 is similar to the previously described embodiment of FIGS. 1–4, but does not include projecting pin 24 that mates with an opening in the other frame section. Secure retention of the two frame sections in this embodiment is provided by U-shaped clip 28 and by frictional engagement of glass pane 22 in internal grooves 20 of frame sections 10, 12.

While the invention has been described herein with regard to presently preferred embodiments, it will be apparent that modifications may be made without necessarily departing from the spirit and scope of the invention as defined by the following claims.

What is claimed is:

1. A picture frame construction assembly comprising first and second frame sections, first and second openings respectively formed in each of said sections, and a frame support member having free ends adapted to be respectively received in said first and second openings, said frame support member when inserted into said first and second openings being effective to provide a unitary assembly of said first and second frame sections and said frame support member extending from said first and second frame section to provide a support for the assembled picture frame on a horizontal surface.

2. The picture frame assembly of claim 1, in which each of said frame sections is a C-shaped section having an internal groove for receiving opposite ends of a glass pane.

3. The picture frame assembly of claim 2, further including a lateral projection in one of said frame sections, and an opening in the other of said frame sections for receiving said lateral projection.

4. The picture frame assembly of claim 3, further comprising a second pair of openings in one of said frame sections for receiving the free ends of said support member.

5. The picture frame assembly of claim 4, in which each of said frame sections includes a vertical segment and upper and lower legs extruding laterally therefrom with an additional pair of openings being formed in said vertical segment of said one of said frame sections, said first and second openings being respectively formed in the leg portions of said first and second frame sections.

6. The picture frame assembly of claim 5, in which said projection extends from one of the legs of one of said frame sections and the respective opening for receiving said projection is formed on one of the legs of the other of said frame sections.

7. The picture frame assembly of claim 1, further including a lateral projection in one of said frame sections, and an opening in the other of said frame sections for receiving said lateral projection.

8. The picture frame assembly of claim 7, further comprising a second pair of openings in one of said frame sections for receiving the free ends of said support member.

9. The picture frame assembly of claim 8, in which each of said frame sections includes a vertical segment and upper and lower legs extruding laterally therefrom with an additional pair of openings being formed in said vertical segment of said one of said frame sections, said first and second openings being respectively formed in the leg portions of said first and second frame sections.

10. The picture frame assembly of claim 9, in which said projection extends from one of the legs of one of said frame sections and the respective opening for receiving said projection is formed on one of the legs of the other of said frame sections.

11. A method of assembling a picture frame comprising the steps of inserting one portion of a glass pane into an interior groove provided in a first frame section having legs, bringing a second frame section having legs into juxtaposition with said first frame section so that the remaining portion of said glass pane is received within an internal groove formed in said second frame section and the legs of said first and second frame sections are brought into contact with one another, inserting free ends of a U-shaped clip into first and second openings respectively formed in adjacent locations in one leg of each of said first and second frame sections, said inserted clip serving to retain said first and second frame sections in a secure frame assembly and to provide support for the assembled picture frame.

* * * * *